US006637483B2

(12) United States Patent
Stager et al.

(10) Patent No.: US 6,637,483 B2
(45) Date of Patent: Oct. 28, 2003

(54) METHOD AND APPARATUS FOR PROFILING A LOG

(75) Inventors: Bradley R. Stager, Beaverton, OR (US); John S. Luecke, Milwaukie, OR (US)

(73) Assignee: Key Knife, Inc., Tualatin, OR (US)

( * ) Notice: Subject to any disclaimer, the term of this patent is extended or adjusted under 35 U.S.C. 154(b) by 82 days.

(21) Appl. No.: 10/013,895

(22) Filed: Dec. 7, 2001

(65) Prior Publication Data

US 2002/0043297 A1 Apr. 18, 2002

Related U.S. Application Data

(63) Continuation of application No. PCT/US00/15937, filed on Jun. 8, 2000.

(51) Int. Cl.[7] ..... B27C 5/00

(52) U.S. Cl. ..... 144/373; 144/218; 144/39; 144/241; 144/235; 407/46; 407/101

(58) Field of Search ..... 144/39, 218, 220, 144/222, 223, 235, 241, 43, 44, 228; 407/40, 41, 45, 46, 87, 95, 101, 104

(56) References Cited

U.S. PATENT DOCUMENTS

| | | | | |
|---|---|---|---|---|
| 1,222,871 A | | 4/1917 | Jesseph | |
| 3,780,778 A | | 12/1973 | Chapman | |
| 3,976,112 A | | 8/1976 | Rowlson et al. | |
| 4,327,789 A | | 5/1982 | Reuter | |
| 4,335,767 A | | 6/1982 | Reuter | |
| 4,848,427 A | | 7/1989 | Reuter | |
| 4,984,614 A | * | 1/1991 | Landers et al. | 144/220 |
| 5,421,386 A | | 6/1995 | Lundstrom | |
| 5,617,908 A | | 4/1997 | Toogood | |
| 5,709,255 A | | 1/1998 | Toogood | |
| 5,816,301 A | | 10/1998 | Stager | |
| 6,058,992 A | | 5/2000 | Stager et al. | |
| 6,167,929 B1 | | 1/2001 | Stager et al. | |

FOREIGN PATENT DOCUMENTS

| | | |
|---|---|---|
| DE | 3208377 A1 | 10/1983 |
| DE | 44 19 324 A1 | 6/1994 |
| EP | 0 273 914 | 10/1986 |
| EP | 0 663 272 B1 | 12/1994 |
| EP | 95 02104 | 2/1995 |
| EP | 0 744 255 A2 | 6/1996 |
| FR | 79 22107 | 9/1979 |
| FR | 79 22108 | 12/1979 |
| FR | 81 22198 | 11/1981 |
| WO | WO 92/22402 | 12/1992 |

* cited by examiner

*Primary Examiner*—W. Donald Bray
(74) *Attorney, Agent, or Firm*—Birdwell, Janke & Durando, PLC

(57) ABSTRACT

A method and apparatus for profiling a log. In a profiler having first and second knives disposed on a rotating disc, a mounting member is adapted to mountably receive both the first and second knives so that each blade has a point on its cutting edge that is proximate a point that is on the cutting edge of the other knives. Preferably, the points are end most points and abut one another.

15 Claims, 7 Drawing Sheets

METHOD AND APPARATUS FOR PROFILING A LOG

This application is a continuation of PCT/US00/15937 filed Jun. 8, 2000.

TECHNICAL FIELD

The present invention relates to a method and apparatus for profiling a log, particularly for cutting a reentrant corner in the log that extends along the log.

BACKGROUND ART

To process logs into standard lumber, the logs are first slabbed on one to four sides. To avoid waste and, because the cross-section of the log is generally round, this processing intentionally leaves four rounded corners. Referring first to FIGS. 1A and 1B depicting, respectively, the cross-section of the log before and after being slabbed on four sides and then turning to FIG. 1C, the rounded corners are removed by cutting into the log along its longitudinal axis corresponding reentrant corners "C." This squares portions of the log, indicated in the Figure as "A", that are located between the contours of adjacent corners so that the portions are configured to be cut into pieces of standard lumber. Forming the corners C is typically referred to as "profiling" and an apparatus adapted for this purpose is typically referred to as a "profiler."

An example of a prior art profiler is shown in FIG. 2. First and second knives 2 and 4, which are identical, are disposed on the circumference of a rotating disc 6. A slabbed log 8 having an elongate axis "L" is fed toward the disc along a circumferential direction "d." The cutting edge of the first knife is oriented parallel to the axis of rotation of the disc and the cutting edge of the second knife is oriented in a plane of rotation of the disc. Referring back to FIG. 1C, the first knife cuts a first leg "11" of a particular reentrant corner C and the second knife cuts a perpendicular, second leg "12" of the reentrant corner, wherein the legs 11 and 12 meet at a region of intersection "c1" of the corner C. It should be understood that the legs "11" and "12" are the visible portions of planar surfaces extending along the longitudinal axis of the log.

Another example of a prior art profiler replaces the second knife with a sequence of cutting teeth disposed around the periphery of the disc, such as the teeth of a saw blade.

In both of these profilers, the first and second knives are disposed so that the first knife meets the log at a different time than does the second knife. Because there is relative movement between the disc and the log, this time difference provides an opportunity for the two cuts to fail to intersect precisely at the same corner region c1 and thereby fail to form a clean or smooth corner C. In particular, there often results, running longitudinally along the corner C, "feathers" or slivers of wood partially but not completely removed from the log, or other unevenness in the surface texture of the corner. This result is often aggravated further as wear occurs in the apparatus.

Accordingly, there is a need for a method and apparatus for profiling a log that provides for the formation of smoother surfaces in corners cut thereby and for maintaining this capability despite wear in the apparatus.

DISCLOSURE OF INVENTION

A method and apparatus for profiling a log according to the present invention solves the aforementioned problems and meets the aforementioned needs by providing in a profiler having first and second knives disposed on a rotating disc, wherein the first and second knives have respective cutting edges defining an angle therebetween that is typically but not necessarily 90 degrees, a mounting member that is adapted to mountably receive both the first and second knives so that each blade has a point on its cutting edge that is proximate a point that is on the cutting edge of the other knife. Preferably, the points of the cutting edges that are proximate are the ends of the cutting edges and, preferably, the proximity is such that the points abut one another.

Preferably, an abutting relationship of the tips of the knives is maintained against the forces typically encountered by the knives during use. The knives preferably include keyways that mate with corresponding keys in a mounting member for holding the knives. The keyways and keys substantially prevent the knives from moving in response to the forces.

In another aspect of the invention, the cutting edge of at least one of the knives is angled to avoid cutting the log parallel to the grain, to further improve the surface finish in profiling the log.

Therefore, it is a principal object of the present invention to provide a novel and improved method and apparatus for profiling a log or other elongate article.

It is another object of the present invention to provide such a method and apparatus that provides for the formation of smoother surfaces in corners cut thereby.

It is still another object of the present invention to provide such a method and apparatus that provides for maintaining the aforementioned capability despite wear in the apparatus.

The foregoing and other objects, features and advantages of the present invention will be more readily understood upon consideration of the following detailed description of the invention, taken in conjunction with the following drawings.

BEST MODE FOR CARRYING OUT THE INVENTION

Figure 1A:
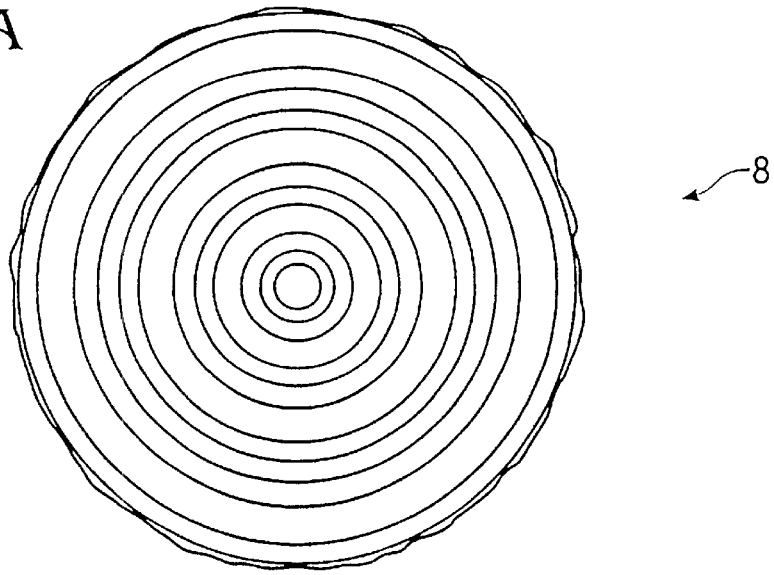
FIG. 1A is a cross-section of a log.
Figure 1B:
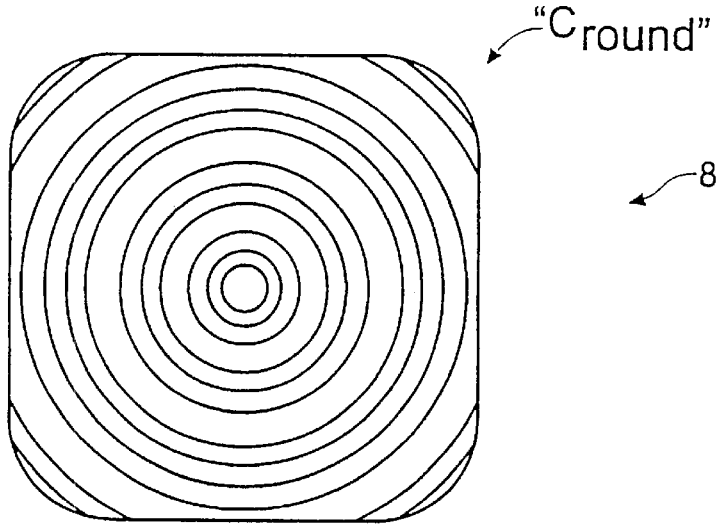
FIG. 1B is a cross-section of the log of FIG. 1A after having been slabbed.
Figure 3:
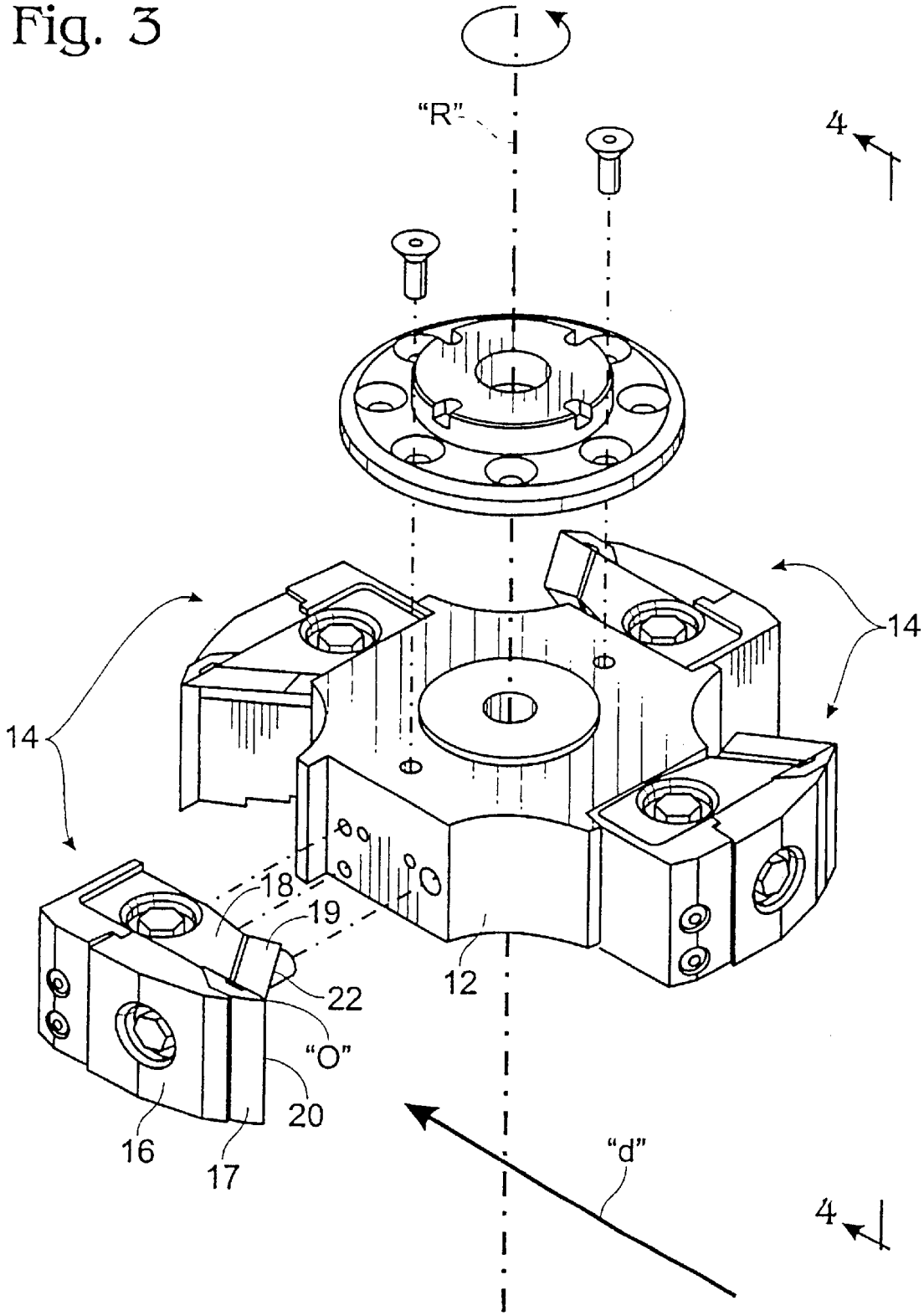
FIG. 3 is a partially exploded view of a profiling apparatus according to the present invention, showing a single rotor and a preferred mounting member.
Figure 4:
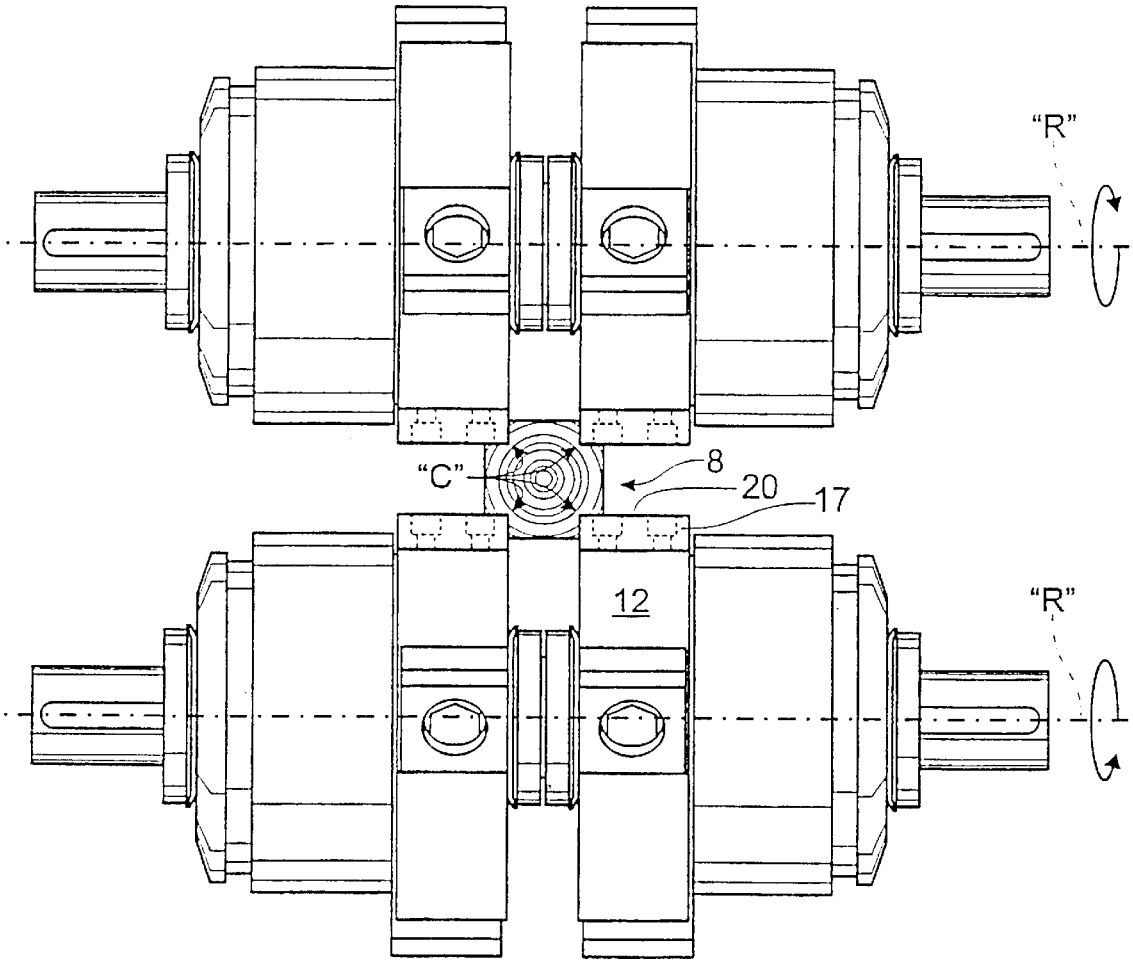
FIG. 4 is a side elevation of the profiling apparatus of FIG. 3, taken along a line 4—4 thereof, showing four rotors.

A profiling apparatus 10 according to the present invention is shown in FIGS. 3 and 4. The profiling apparatus is particularly adapted for profiling a log; however, it may be employed for profiling any elongate article. The term "profiling" means fundamentally to alter the shape of the article for some productive purpose. Referring back to FIGS. 1B and 1C, typically, this involves altering an elongate form such as the rounded corner "Cround" of a slabbed log into an elongate, reentrant, square corner "C." This configures the material indicated in FIG. 1C as "A" which lies between the contours of neighboring corners C into an orthohombic configuration, or "squares" the material. It should be borne in mind throughout that other reentrant shapes could be formed, or corners could be formed having other angles varying from 90 degrees, where that is desirable, and the operation could be performed on elongate articles other than logs without departing from the principles of the invention.

Figure 2:
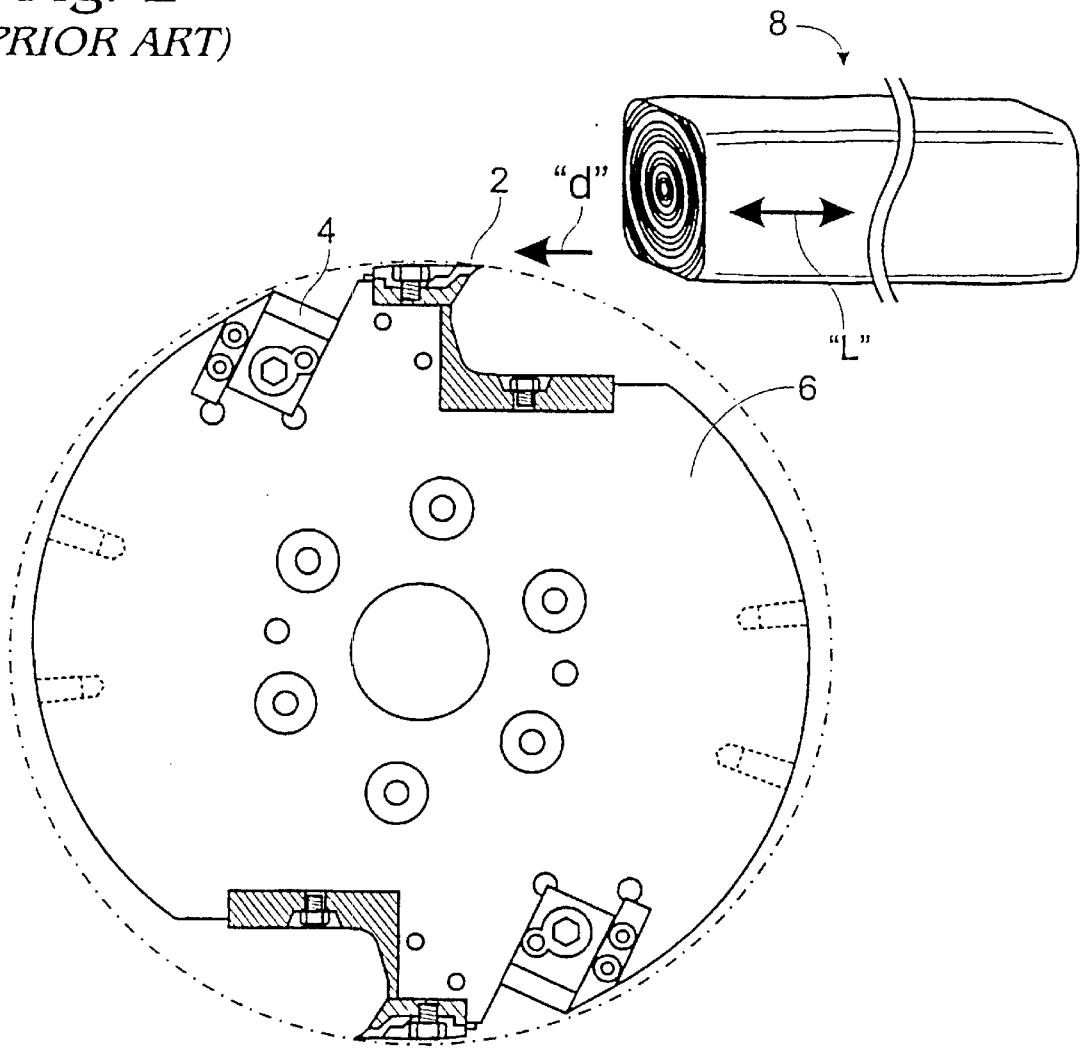
Fig. 2 (PRIOR ART)
FIG. 2 is a plan view of a first prior art profiling apparatus.

Referring to FIG. 3, a rotor 12 is provided with a desired number of mounting members 14, such as four. The rotor may be disc shaped or it may have some alternative configuration such as that shown. As shown in both FIGS. 3 and 4, the rotor rotates about an axis "R." As in FIG. 2, a slabbed log 8 having an elongate axis "L" is fed toward the rotor along a circumferential direction "d" which is represented in FIG. 4 and which is perpendicular to the plane of FIG. 5.

Each mounting member 14 includes two holders 16 and 18. Each holder is adapted to clamp an associated knife 17 and 19 to the mounting member. The knives may be any cutting implements including, for example, saw teeth. The mounting member is, in turn, adapted for mounting to the rotor 12. The identification of discrete parts such as the mounting member and rotor may be somewhat arbitrary since these parts could be combined into an integral unit and function identically for purposes of the present invention. However, it is often preferable to provide these components as individual parts that are adapted to be connected together with machine screws or bolts.

The holders 16 and 18 are adapted for clamping their respective knives to the mounting element and for releasing the knife to allow the knife to be removed therefrom. Any of a number of prior art holders may be employed. A particularly advantageous holder is that described in U.S. Pat. No. 5,979,522, which is shaped to fit knives marketed by Key Knife, Inc., under the trademark KEYKNIFE.

Figure 5:
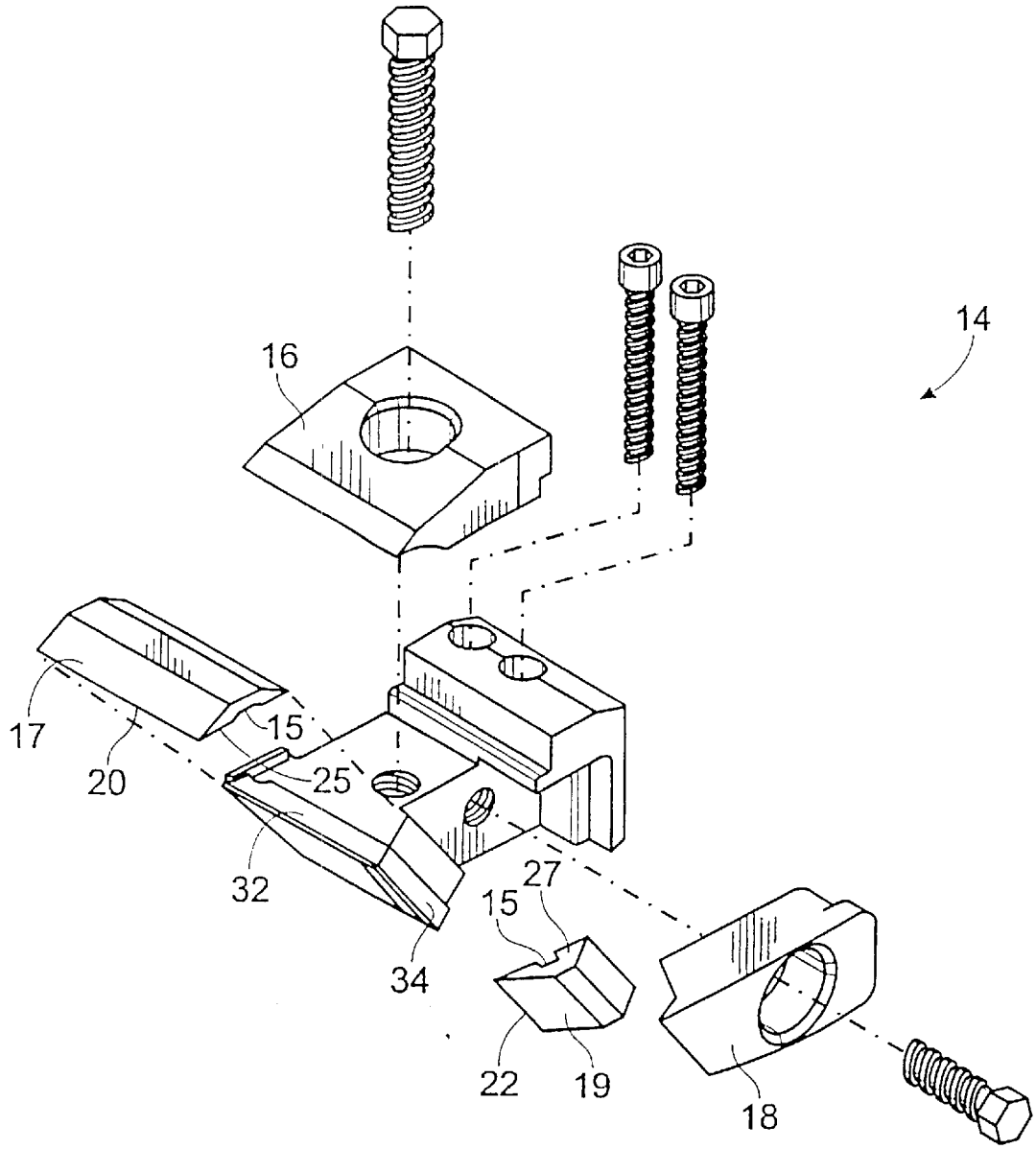
FIG. 5 is an exploded view of the preferred mounting member of FIG. 3.

FIG. 5 presents a more detailed view of a preferred mounting member 14 as shown in FIG. 3. The knives 17 and 19 have respective cutting edges 20 and 22. The knife 17 is mounted by the holder 16 to the mounting member 14 so that the cutting edge 20 extends parallel to the rotational axis "R" of the rotor. The knife 19 is mounted by the holder 18 to the mounting member so that the cutting edge 22 lies in a plane of rotation of the rotor. The cutting edges 20 and 22 are typically disposed to form a 90 degree angle therebetween, for cutting a square corner C.

Referring particularly to FIG. 5, the knives are preferably adapted so that a back side of the knife 17 abuts a side surface 25 of the knife 19 to form a mitered corner. For this purpose, the side surface 25 of the knife 19 is angled obliquely with respect to the cutting edge 22, and for cutting opposite corners C, left and right handed versions of the angle and, therefore, the knife 19 may be provided.

The cutting edges define lines composed of a number of points. Cutting action by each knife creates respective surfaces, typically though not necessarily planes, as a result of the cutting edges progressing through the work as a result of relative movement there between. Similarly, cutting action resulting from a particular point on a cutting edge creates a line, typically though not necessarily straight, as a result of the relative movement. In the instant invention, the mounting member is configured so that at least one of the points on one of the cutting edges is proximate at least one of the points on the other of the cutting edges. Preferably, these points are end points "O" of the respective cutting edges and, preferably, these points abut one another, such as shown in FIG. 4.

Particularly, where the cutting edges are brought into proximate coincidence at their end points "O", i.e., their tips, it has been found that this coincidence is preferably no more than about ⅛" for notable minimization of surface irregularities such as "waviness" and feathers, with 1/16" being a more desirable outer limit for commercial practice. It has also been found that decreasing the chip size generally permits a larger separation between the points for purposes of minimizing waviness, but the generation of feathers is not substantially affected. Neither waviness nor the generation of feathers is substantially affected by the size of the knives.

In addition to recognizing that it is important to arrange the knives in a close tip-to-tip relationship to improve cutting finish, the present inventors have also recognized the importance of providing for maintaining such a relationship during use of the apparatus. A chipping knife is typically clamped to a mounting member by a knife holder, e.g., a bolt extending through the knife holder into either the mounting member or the rotor. During use of the apparatus, the bolt may loosen, allowing the knife some latitude to slip backwardly from the direction of rotation. Where two knives that were arranged in tip-to-tip abutting relationship slip in unequal amounts, a gap develops therebetween. Moreover, any gap so formed may become packed with debris from the log, the packing causing the knives to spread further and further apart from one another during continued use.

In accord with the invention, corresponding mating features are provided in the knives 17 and 19 and the mounting member 14, to substantially lock the knives into a selected position with respect thereto, for maintaining an abutting relationship of the tips of the knives even when the clamping force for holding the knife exerted by the holders 16 and 18 to the mounting member is reduced to zero.

FIG. 5 shows a preferred structure for this purpose. In the preferred structure, the knives 17 and 19 each include a keyway 15, and the mounting member 14 includes corresponding keys 32 and 34 that are adapted to fit closely the keyways 15 of the knives. The keyways and keys 32 and 34 are adapted so that interlocking the keyways and the keys prevents movement of the knives in a direction perpendicular to their cutting edges, or in the direction of rotation of the mounting member. In the preferred stricture, the keyways are slots formed in the knives extending parallel to the cutting edges of the knives as shown and described more fully in Carpenter et al., U.S. Pat. No. 4,850,408, incorporated by reference herein in its entirety.

Providing for locking the knives to the mounting member rather than the holders 16 and 18 maintains their relative positions. The holders are subject to loosening because they are particularly adapted to apply a clamping force to the knives which must be removable in order to replace the knives.

The closeness of fit between the keys and keyways is allowed to vary depending on the allowable separation of the tips of the knives. Preferably for maintaining a substantially abutting relationship of the tips of the knives, the keys should fit the keyways to a tolerance of less than about 0 015".

Alternatively, other corresponding mating features in the knives and mounting member could be provided to accomplish the result of substantially locking the knives together, as will be immediately appreciated by the person of ordinary skill. For example, other shapes of keys and keyways may be provided, such as "V" shapes, ridges or ribs in either member. As a further example of keyed corresponding mating features, a pin and aperture combination could be provided. As an example of a non-keyed mating feature, a nonremovable or otherwise rigidly attached "backstop" to the knife could be employed. The backstop would be used in conjunction with the corresponding mating feature defined by the back surface of the knife as defined by the direction of rotation of the knife. Corresponding mating features may be keyed or non-keyed according to the principles of the invention.

Preferably, the mounting member 14 is formed of a single piece of metal, to enhance the security with which the relationship of the knives is maintained. However, this is not essential to the advantage provided by the present invention.

Figure 6:
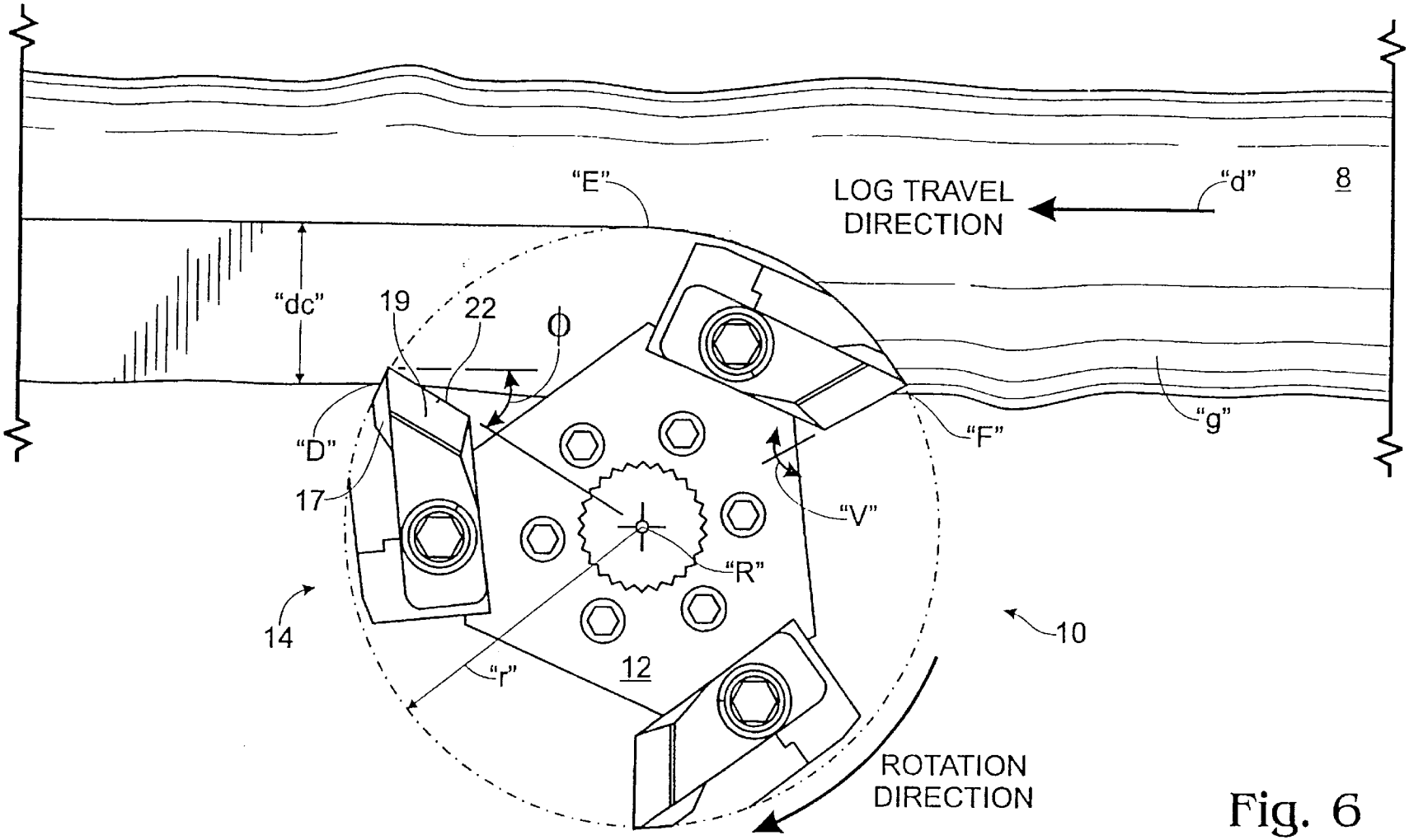
FIG. 6 is a plan view of a profiling apparatus according to the present invention, shown cutting a log.

Turning to FIG. 6, the profiling apparatus 10 is shown in a typical configuration. The log 8 is shown in elevation as traveling in a direction "d" that is substantially along the longitudinal axis of the log. The grain "g" of the log is defined approximately by a series of concentric cylinders having their axes in the direction "d." The rotor 12 is shown provided with three mounting members 14, and the axis of rotation "R" of the rotor is perpendicular to the direction "d." In cutting the log along, its travel direction "d," the knives enter the log at point "D", reach a maximum depth of penetration at point "E" and exit the log at point "F".

Figure 1C:
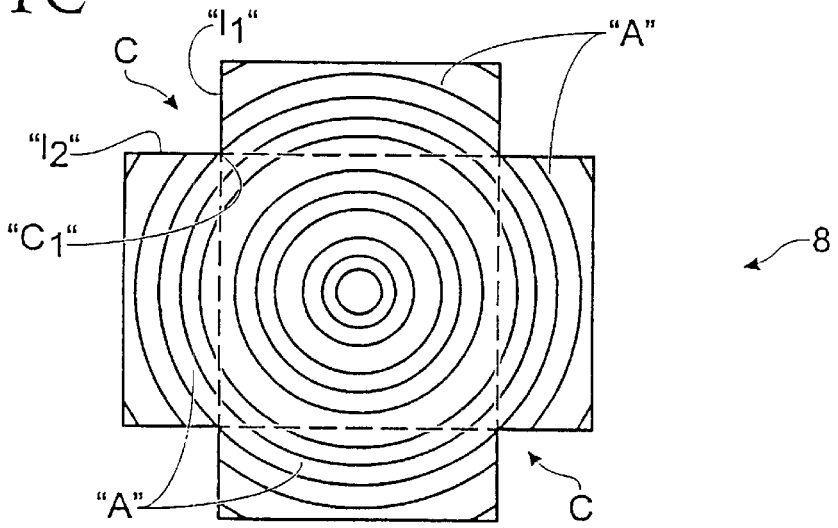
FIG. 1C is a cross-section of the log of FIG. 1B after having been profiled.

The inventors have recognized that for cutting, clean and sharp corners "C" as shown in FIG. 1C, it is most advantageous to avoid cutting the wood with either of the cutting edges 20 or 22 parallel to the grain "g." This is to avoid "pulling up" the fibers making up the grain.

Figure 7:
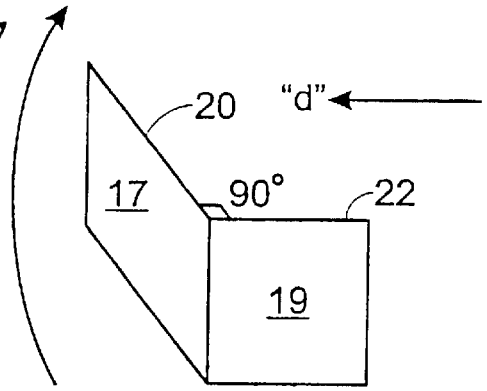
FIG. 7 is a simplified pictorial view of two knives for use in the profiling apparatus of FIG. 6, shown in a first orientation with respect to a direction of travel of the log.
Figure 8:
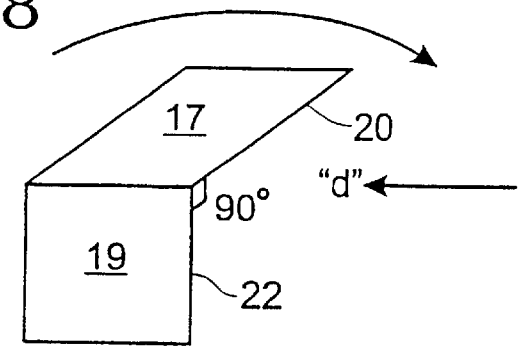
FIG. 8 is another simplified pictorial view of the two knives of FIG. 7, shown in a second orientation with respect to the direction of travel of the log.

As it is depicted in FIG. 6, the knife 17 extends into the plane of the paper and, therefore, its cutting edge 20 is always perpendicular to the grain. However, the angle the knife edge 22 makes with respect to the grain changes along its path from "D" to "E" to "F." This can be appreciated by comparing FIGS. 7 and 8. In both FIG. 7 and FIG. 8, the knives 17 and 19 are shown in a configuration for cutting square corners "C", wherein the angle Θ between the edges 20 and 22 is 90 degrees. However, in FIG. 7, the knives are shown relative to the log travel direction "d" as they would appear at point "D", while in FIG. 8, the knives are shown relative to "d" as they would appear at point "E" in FIG. 6. At point "E" (FIG. 8), both of the cutting edges 20 and 22 are perpendicular to the travel direction "d", and therefore perpendicular to the grain. However, at point "D" (FIG. 7), the cutting edge 22 is parallel to the grain. This is undesirable.

Figure 9:
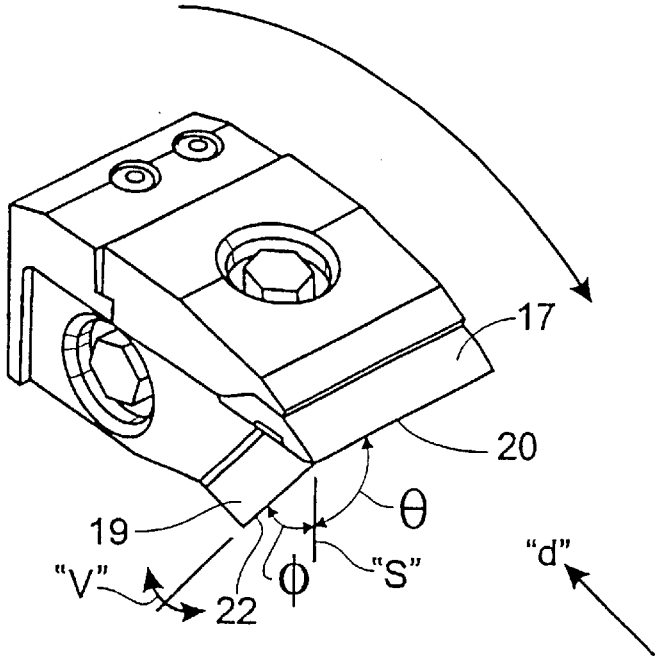
FIG. 9 is a simplified pictorial view of two knives of the profiling apparatus of FIG. 6, shown in a preferred configuration in the second orientation of FIG. 8.

Turning to FIG. 9, the present invention provides a selected angle Φ between the cutting edge 22 and the line "s" defined as being perpendicular to the travel direction "d" and the axis of rotation at point "E." As best seen in FIG. 6, the angle Φ is preferably determined by constructing a radial line extending from the tips of the knives 17 and 19 to the center of the rotor "R", the same result being obtained by projecting, in a plane perpendicular to the axis of rotation, the line extending from the tips of the knives to any point on the axis of rotation.

An angular variation "v" of the angle Φ about the tips of the knives is preferably within about ±15 degrees. As can be appreciated by inspecting FIG. 6 and considering the goal of minimizing parallelism with the grain "g", it is generally desirable that the angle Φ be greater where the depth of penetration "$d_c$" into the log (FIG. 6), as compared to the radius "r" of the are traveled by the tips of the knives, is greater.

The consideration of the angle Φ is substantially independent of the choice of the angle Θ. For example, the projections of the cutting edges 20 and 22 in the direction of rotation of the mounting member 14 that is responsible for the shape of the corner "C" (FIG. 1) remain 90 degrees apart regardless of the choice of the angle Φ.

It is to be recognized that, while a particular method and apparatus for profiling a log has been shown and described as preferred, other configurations could be utilized, in addition to configurations already mentioned, without departing from the principles of the invention. Moreover, there is no intention to limit the invention to use in profiling apparatus where there may be other applications involving similar considerations for which the present invention provides similar advantages.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

What is claimed is:

1. A profiling apparatus adapted to rotate a plurality of cutting knives having respective cutting edges about an axis of rotation, the apparatus comprising a mounting member adapted to mount two of the knives so that the cutting edge of one of said two knives lies substantially in a plane perpendicular to said axis of rotation and within an angular variation of plus or minus 15 degrees, taken about a radially outermost first tip of said one knife, from a line extending from said first tip to said axis of rotation, and the cutting edge of the other of said two knives is parallel to said axis of rotation, and wherein said mounting member is further adapted to mount said two knives so that a tip of said other knife and said first tip substantially abut one another.

2. The profiling apparatus of claim 1, wherein said mounting member is adapted to mount said one knife so that the cutting edge thereof lies substantially on said line.

3. The profiling apparatus of claim 1, including said one knife, wherein said cutting edge thereof defines an angle with respect to an immediately adjacent side thereof that differs substantially from 90 degrees.

4. The profiling apparatus of claim 2, including said one knife, wherein said cutting edge thereof defines an angle with respect to an immediately adjacent side thereof that differs substantially from 90 degrees.

5. A profiling apparatus adapted to rotate a plurality of cutting knives having respective cutting edges about an axis of rotation, the apparatus comprising a mounting member adapted to mount two of the knives so that the cutting edge of one of said two knives lies substantially in a plane perpendicular to said axis of rotation and substantially on a line extending from a radially outermost first tip of said one knife to said axis of rotation.

6. The profiling apparatus of claim 5, wherein said mounting member is further adapted to mount said two knives so that the cutting edge of the other of said two knives is parallel to said axis of rotation.

7. The profiling apparatus of claim 5, including said one knife, wherein said cutting edge thereof defines an angle with respect to an immediately adjacent side thereof that differs substantially from 90 degrees.

8. The profiling apparatus of claim 6, including said one knife, wherein said cutting edge thereof defines an angle with respect to an immediately adjacent side thereof that differs substantially from 90 degrees.

9. A profiling apparatus adapted to rotate a plurality of cutting knives having respective cutting edges about an axis of rotation, the apparatus comprising a mounting member adapted to mount two of the knives so that the cutting edge of one of said two knives lies substantially in a plane perpendicular to said axis of rotation and the cutting edge of the other of said two knives is parallel to said axis of rotation, wherein said mounting member is further adapted to mount said two knives so that a tip of said other knife and said first tip substantially abut one another.

10. The profiling apparatus of claim 9 including said one knife, wherein said cutting edge thereof defines an angle with respect to an immediately adjacent side thereof that differs substantially from 90 degrees.

11. A knife for use in a wood profiling apparatus adapted to rotate the knife about an axis of rotation, the knife being adapted to be mounted in the profiling apparatus, the knife having a cutting edge defining an angle with respect to an immediately adjacent side thereof that differs substantially from 90 degrees.

12. A method for profiling an article of wood, comprising providing a first knife having a cutting edge, rotating the knife about an axis of rotation, orienting the knife so that said cutting edge lies substantially in a plane perpendicular to said axis of rotation, and feeding the article of wood against the knife in a feed direction perpendicular to said axis of rotation so that said cutting edge, at a point of entry of said knife into the article of wood, makes a substantially nonzero angle with respect to the direction of the grain in the article of wood.

13. The method of claim 12, further comprising providing a second knife and disposing, said second knife with respect to said first knife so that respective tips thereof substantially abut one another.

14. The method of claim 12, further comprising providing a second knife and disposing, said second knife so that a cutting edge thereof is substantially parallel to said axis of rotation.

15. The method of claim 14, further comprising disposing said second knife with respect to said first knife so that respective tips thereof substantially abut one another.

* * * * *

UNITED STATES PATENT AND TRADEMARK OFFICE

CERTIFICATE OF CORRECTION

PATENT NO. : 6,637,483 B2
DATED : October 28, 2003
INVENTOR(S) : Bradley R. Stager and John S. Luecke It is certified that error appears in the above-identified patent and that said Letters Patent is hereby corrected as shown below:

Column 8,
Line 12, change “disposing, said” to -- disposing said --;
Line 15, change “disposing, said” to -- disposing said --.

Signed and Sealed this

Nineteenth Day of October, 2004

JON W. DUDAS
*Director of the United States Patent and Trademark Office*